US006805457B2

(12) United States Patent
Kokubo et al.

(10) Patent No.: US 6,805,457 B2
(45) Date of Patent: Oct. 19, 2004

(54) FLAT-SURFACE FLUORESCENT LAMP

(75) Inventors: Hideyuki Kokubo, Saitama (JP); Tomoko Taki, Saitama (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 113 days.

(21) Appl. No.: 10/253,636

(22) Filed: Sep. 25, 2002

(65) Prior Publication Data

US 2003/0058647 A1 Mar. 27, 2003

(30) Foreign Application Priority Data

Sep. 26, 2001 (JP) ..... 2001-294515

(51) Int. Cl.[7] ..... F21V 9/16

(52) U.S. Cl. ..... 362/84; 362/260; 313/495; 313/113; 313/514

(58) Field of Search ..... 362/84, 260; 313/113, 313/492, 495, 513, 514, 515, 522

(56) References Cited

U.S. PATENT DOCUMENTS 4,737,683 A * 4/1988 Shichao et al. ..... 313/495

5,479,071 A * 12/1995 Lynn ..... 313/514

FOREIGN PATENT DOCUMENTS

| | | |
|---|---|---|
| JP | 3-30252 | 2/1991 |
| JP | 5-2897 | 2/1993 |

* cited by examiner

*Primary Examiner*—Stephen F. Husar
(74) *Attorney, Agent, or Firm*—Sughrue Mion, PLLC

(57) ABSTRACT

A fluorescent lamp comprises a cathode panel, an anode panel and a light-output panel. A filament and grid electrodes are attached to the cathode panel. The anode panel is provided with a reflection layer and a fluorescent layer. The light-output panel is made of a transparent glass plate and is disposed on a plane different from the cathode panel and the anode panel. An electron beam emitted from the filament collides with the fluorescent layer. Upon this, the fluorescent layer is excited to emit light. The emitted light is reflected by the reflection layer to radiate from the light-output panel toward the outside of the fluorescent lamp. At this time, the light does not pass through the grid electrodes and the filament so that optical unevenness is prevented from occurring.

12 Claims, 3 Drawing Sheets

FLAT-SURFACE FLUORESCENT LAMP

BACKGROUND OF THE INVENTION

1. Field of the Invention

The present invention relates to a flat-surface fluorescent lamp, and more particularly to a flat-surface fluorescent lamp of a reflection type in which reflected light is outputted through a plane different from an anode panel.

2. Description of the Related Art

Various flat fluorescent lamps have been invented. In this kind of the fluorescent lamp, fluorescent material is excited by an electron beam. As to these flat fluorescent lamps, there are a transmission type and a reflection type. In the transmission type, such as described in Japanese Patent Laid-Open Publication No. 3-30252, a fluorescent-material layer is formed on an inner surface of an anode panel made of a transparent glass plate. From this anode panel, light radiates.

The flat fluorescent lamp of the transmission type has the anode panel whose calorific value is large. Thus, when using the transmission type as a back light of a liquid-crystal display and so forth, there arises a problem in that sometimes heat radiating from the anode panel exercises a bad influence. In order to solve this problem, Japanese Patent Laid-Open Publication No. 5-28972 discloses a fluorescent lamp in which a fluorescent-material layer and a reflection layer are formed on an anode panel to radiate the light through a cathode panel made of a transparent glass plate.

However, in the fluorescent lamp described in the above-noted Publication No. 5-28972, the light passes a line-form filament and a mesh-form grid, and then, the light radiates from the cathode panel. Due to this, line-like unevenness and mesh-like unevenness are caused in the emitted light. These sorts of unevenness are dissolved by making an outer surface of the cathode panel a ground glass. In this case, however, there arises a problem in that transmittance is lowered so that a light amount is reduced.

SUMMARY OF THE INVENTION

In view of the foregoing, it is a primary object of the present invention to provide a fluorescent lamp of a reflection type in which unevenness of light is prevented from occurring.

It is a second object of the present invention to provide a fluorescent lamp of a reflection type in which a light amount is prevented from reducing.

In order to achieve the above and other objects, the fluorescent lamp according to the present invention comprises an anode panel, a cathode panel, a filament, grid electrodes, and a light-output panel. The inside of the anode panel is formed with a reflection layer and a fluorescent layer. The cathode panel is disposed on a plane different from the anode panel. The filament is attached to the inside of the cathode panel. The grid electrodes are disposed between the filament and the anode panel. The light-output panel is made of a transparent glass plate and is disposed on another plane different from the anode panel and the cathode panel.

An electron beam emitted from the filament collides with the fluorescent layer. Upon this, the fluorescent layer is excited to emit light. The emitted light is reflected by the reflection layer to radiate from the light-output panel toward the outside of the fluorescent lamp.

In a preferred embodiment, the outside of the anode panel is provided with a heat-radiating plate. Further, the fluorescent lamp comprising the anode panel, the cathode panel and the light-output panel has a triangular-prism shape. Alternatively, the fluorescent lamp may have a polygonal section.

According to the fluorescent lamp of the present invention, the light generated by the fluorescent layer radiates from the fluorescent lamp without passing through the filament and the mesh-form grid electrode. Thus, it is possible to prevent unevenness from occurring in the light. Since the unevenness does not occur in the light, a transparent glass plate may be used as the light-output panel.

The light-output panel is provided separately from the cathode panel and the anode panel so that it is possible to efficiently cool the anode panel from the outside thereof. The fluorescent lamp has the triangular-prism shape so that mechanical strength may be improved. Meanwhile, when the fluorescent lamp has the polygonal section, it is possible to separately manufacture a cathode-panel side and an anode-panel side. Thus, manufacture efficiency may be improved.

Further, in a case that the cathode panel and the anode panel are made of a material having a coefficient of expansion which is identical with that of the light-output panel, joint portions of the respective panels are prevented from being damaged due to a mismatch of the coefficient of expansion when heating. In a case that the cathode panel and the anode panel are made of a material having lower transmittance in comparison with the light-output panel, it is possible to prevent the light from leaking through the other portions except the light-output panel.

BRIEF DESCRIPTION OF THE DRAWINGS

The above objects and advantages of the present invention will become apparent from the following detailed description of the preferred embodiments of the invention when read in conjunction with the accompanying drawings, in which.

DETAILED DESCRIPTION OF THE PREFERRED EMBODIMENT(S)

Figure 1:
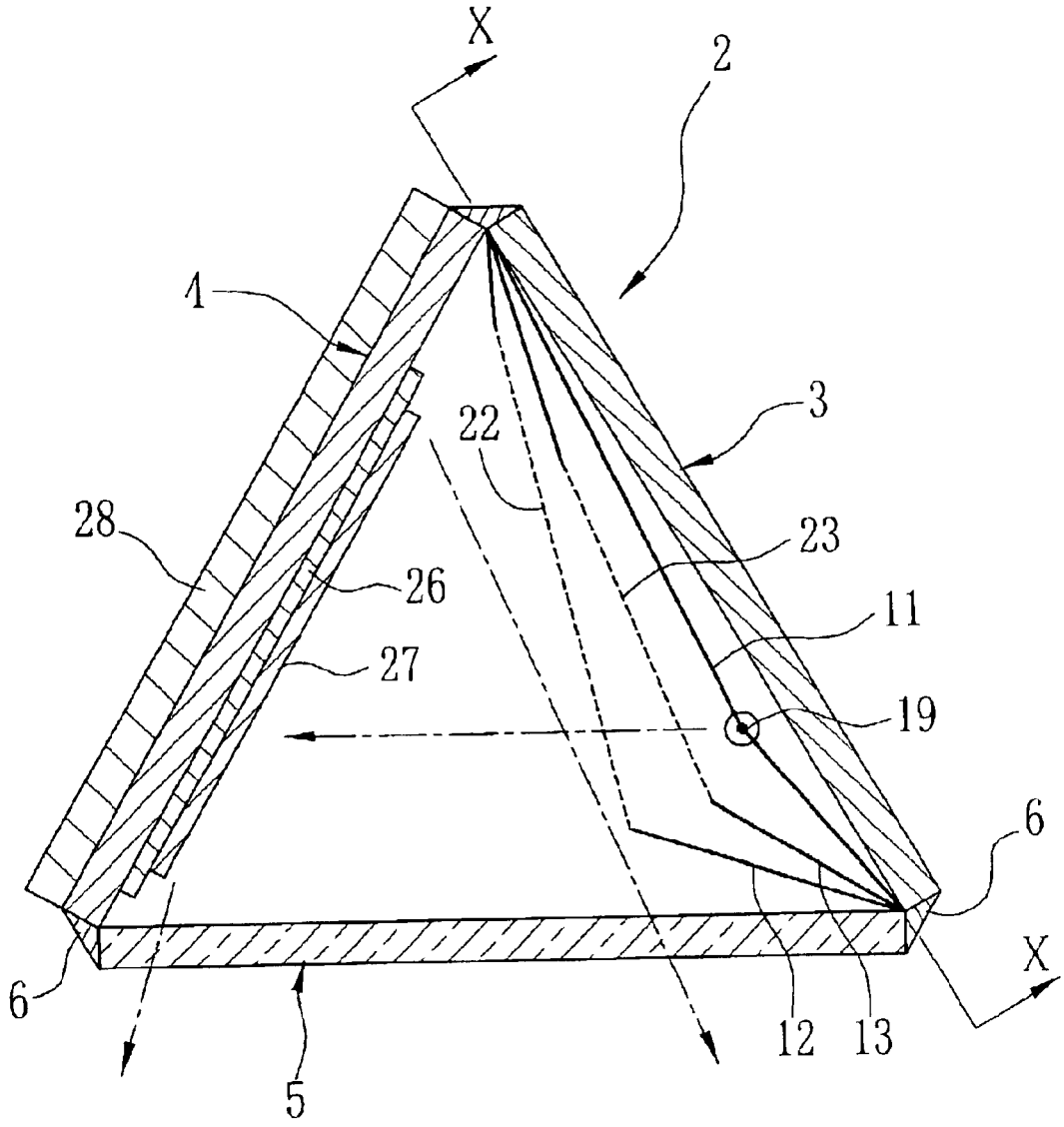
FIG. 1 is a section view partially showing a fluorescent lamp of a triangular-prism shape according to the present invention.
Figure 2:
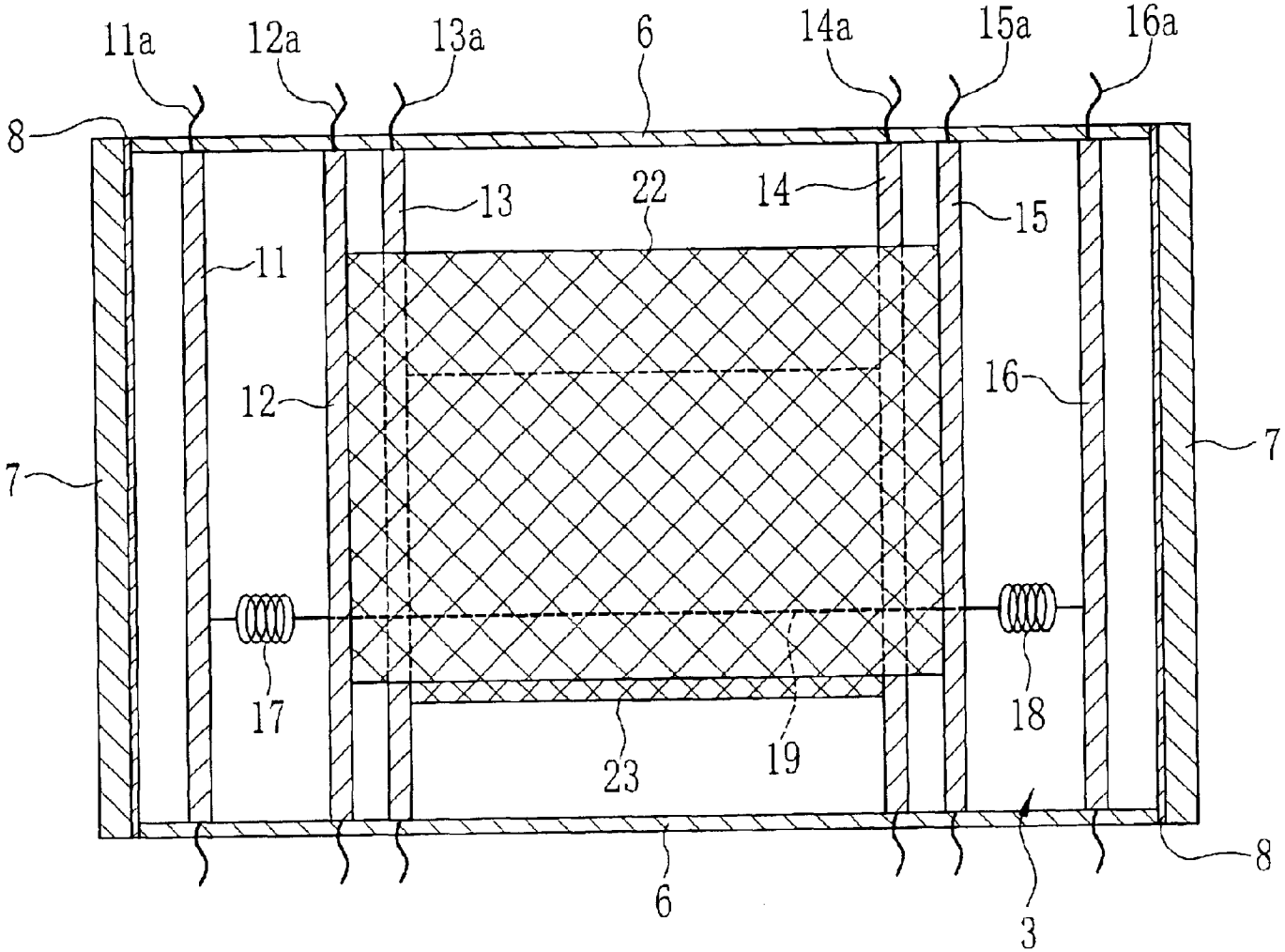
FIG. 2 is an explanatory illustration showing a cathode panel viewed from the inside of the fluorescent lamp.

FIG. 1 is a section view partially showing a flat-surface fluorescent lamp of a reflection type according to the present invention. FIG. 2 is a section taken on line X—X in FIG. 1. The fluorescent lamp 2 comprises a cathode panel 3, an anode panel 4 and a light-output panel 5. The cathode panel 3 and the anode panel 4 are made of a material of ceramics and so forth having a coefficient of expansion which is substantially identical with that of the light-output panel 5. Moreover, this material has lower transmittance in comparison with the light-output panel 5. The light-output panel 5 is made of a transparent glass plate. Each edge of the respective panels 3 to 5 abuts on one edge of the adjacent panel and adheres thereto with a frit glass 6 so that the fluorescent lamp 2 has a triangular-prism shape.

To both ends of a triangular-prism body, which is formed by joining the cathode panel 3, the anode panel 4 and the light-output panel 5, triangular plates 7 adhere with a frit glass 8 to cover the fluorescent lamp 2 tightly. The triangular plate 7 is made of the same material with the cathode panel 3 and the anode panel 4. In this way, the flat-surface fluorescent lamp 2 has the triangular-prism shape so that good mechanical strength is obtained and there are no useless parts.

The inside of the cathode panel 3 is provided with six retainers 11 to 16, which are support members made of a metal having conductivity. The retainers 11 to 16 are arranged so as to cross the cathode panel 3. The outermost two retainers 11 and 16 hold a filament (cathode) 19 via springs 17 and 18 made of a metal having conductivity. The springs 17 and 18 pull the filament 19 at constant force so as not to slack the filament 19. Ends of the retainers 11 and 16 are respectively provided with leads 11*a* and 16*a*, which pass through the frit glass 6 and are drawn out of the fluorescent lamp 2. The leads 11*a* and 16*a* are used for applying a voltage.

Two grid electrodes 22 and 23 having a mesh form are attached to the four retainers 12 to 15. The grid electrodes 22 and 23 controls an electron beam. Incidentally, angles of the retainers 12 to 15 relative to an inner surface of the cathode panel 3 are changed so as to prevent the grid electrodes 22 and 23 from interfering with each other. Ends of the four retainers 12 to 15 are also provided with leads 12*a* to 15*a*, which pass through the frit glass 6 and are drawn out of the fluorescent lamp 2.

An inner surface of the anode panel 4 is formed with a reflection layer 26 made of a metal (aluminum, for instance) having high reflectance. On the reflection layer 26, a fluorescent layer 27 is formed. An outer surface of the anode panel 4 is provided with a heat-radiating plate 28 made of a material (aluminum, for instance) having high thermal conductivity. When attaching the heat-radiating plate 28 to the anode panel 4, it is preferable that an adhesive having thermal conductivity is used so as not to disturb heat conduction.

Next, an operation of the above structure is described below. A voltage is applied to the filament 19 via the lead 11*a*, the lead 16*a*, the retainer 11 and the retainer 16. Upon this, the electron beam is emitted from the filament 19. The emitted electron beam is controlled by the grid electrodes 22 and 23, and is accelerated by potential difference caused between the anode panel 4 and the filament 19. Then, the electron beam collides with the fluorescent layer 27.

The fluorescent layer 27 is excited by the collision of the electron beam to emit the light. The emitted light is reflected by the reflection layer 26 to radiate from the light-output panel 5 toward the outside of the fluorescent lamp 2. At this time, the light does not pass through the grid electrodes 22, 23 and the filament 19 so that unevenness is prevented from occurring in the light radiating from the light-output panel 5.

Energy of the electron beam entering the fluorescent layer 27 is partially lost so that a temperature of the anode panel 4 rises. However, since the heat-radiating plate 28 is attached, the anode panel 4 is efficiently cooled down. In this way, heat of the anode panel 4 is efficiently radiated. Owing to this, it is possible to thicken the fluorescent layer 27 so that light intensity may be increased.

Figure 3:
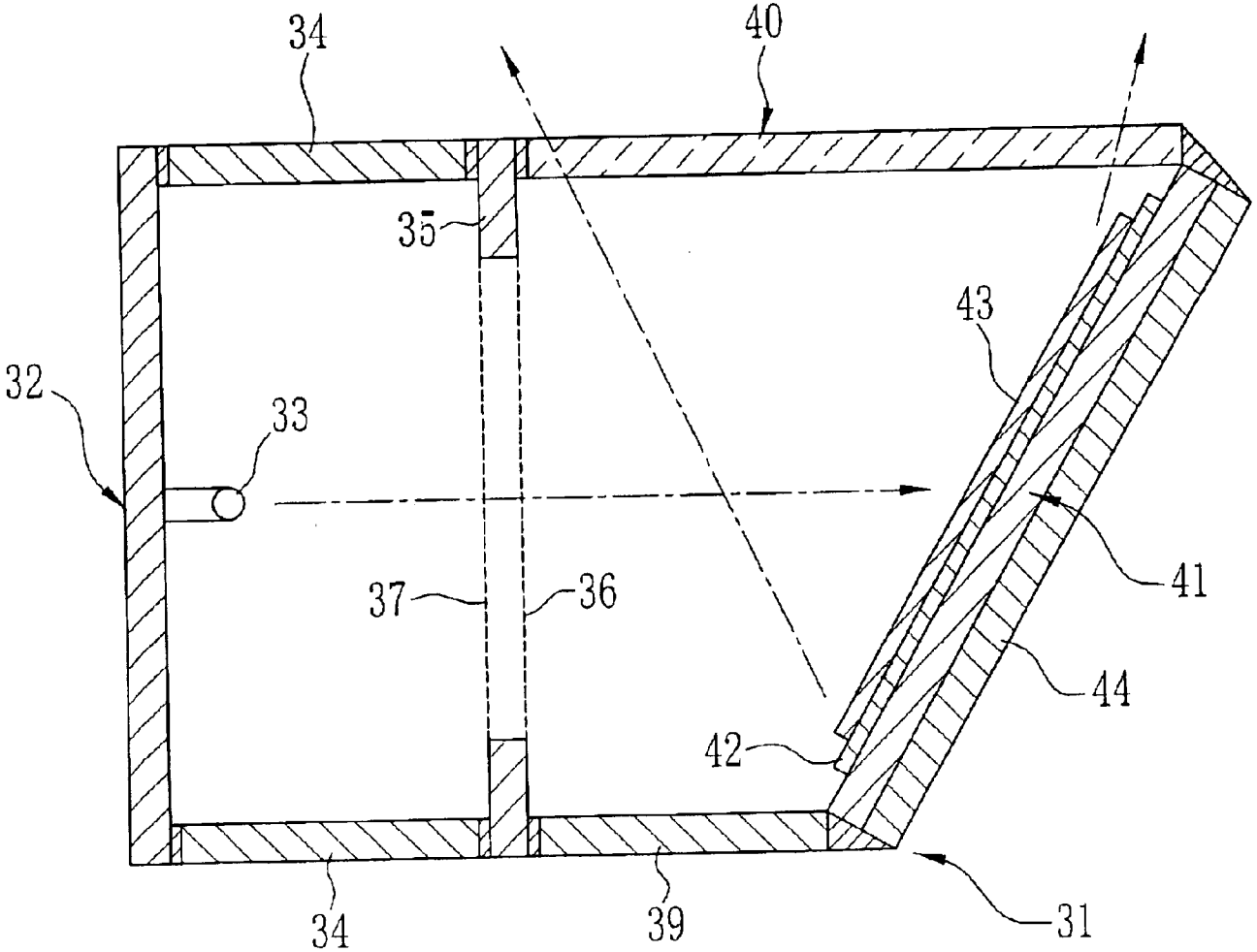
FIG. 3 is a section view partially showing a fluorescent lamp of another embodiment.

In the above embodiment, the fluorescent lamp has the triangular-prism shape. However, such as shown in FIG. 3, a flat-surface fluorescent lamp 31 may be formed so as to have a polygonal section, for example, a square section. In this embodiment, a filament 33 is attached to a cathode panel 32 vertically disposed. Further, a grid panel 35 confronts the cathode panel 32 via four spacers 34.

Two grid electrodes 36 and 37 having a mesh form are attached to the grid panel 35. In front of the grid panel 35, a tilted anode panel 41 is disposed via three spacers 39 and a light-output panel 40. An inner surface of the anode panel 41 is formed with a reflection layer 42 and a fluorescent layer 43, and an outer surface thereof is provided with a heat-radiating plate 44.

In this embodiment, when a voltage is applied to the filament 33, an electron beam is emitted from the filament 33. The emitted electron beam is accelerated and collides with the fluorescent layer 43. Upon this, the fluorescent layer 43 is excited to emit the light. The emitted light is reflected by the reflection layer 42 and radiates from the light-output panel 40 toward the outside of the fluorescent lamp 31. At this time, the light does not pass the grid electrodes 36, 37 and the filament 33 so that unevenness is prevented from occurring in the light radiating from the light-output panel 40. Similarly to the foregoing embodiment, a temperature of the anode panel 41 rises. However, it is possible to efficiently cool the anode panel 41 by means of the heat-radiating plate 44.

The fluorescent lamp 31 may be divided at a portion of the grid panel 35. In this case, a cathode-panel side and an anode-panel side are separately manufactured, and then, the cathode-panel side and the anode-panel side are united.

The flat-surface fluorescent lamps described in the above embodiments may be used as a fixing unit of a printer, a projector, an exposure device and so forth. The fixing unit optically fixes a recorded image and the exposure device is used in producing a semiconductor and a printed circuit board. Especially, since the light-output panel does not have electric potential, it is unnecessary to take potential difference into consideration when the light-output panel closely contacts with a recording paper and so forth at the time of exposure.

The present invention, in which the light-output panel is used to form the triangular-prism shape and the polygonal section, is applicable to a plasma display panel which employs a cathode panel and an anode panel similarly to the flat-surface fluorescent lamp.

In the above embodiments, the sole filament is used. However, a plurality of filaments (cathodes) may be attached to the retainers.

It is considered to provide a transparent protect layer or a transparent electrode layer through which the light passes to reach the surface of the fluorescent layer. The transparent protect layer and the transparent electrode layer are capable of preventing damage caused by the electron beam.

The light-output panel is not limited to the flat, but may be a curved form including a part of a column, a part of a sphere, and an irregular curve.

Although the present invention has been fully described by way of the preferred embodiments thereof with reference to the accompanying drawings, various changes and modifications will be apparent to those having skill in this field. Therefore, unless otherwise these changes and modifications depart from the scope of the present invention, they should be construed as included therein.

What is claimed is:

1. A fluorescent lamp comprising:

an anode panel having a reflection layer and a fluorescent layer arranged on an inner surface thereof;

a cathode panel disposed on a plane different from said anode panel, said cathode panel constituting a sealed body together with said anode panel;

a filament disposed inside said cathode panel;

a grid electrode disposed between said filament and said anode panel; and a transparent light-output panel disposed on another plane different from said anode panel and said cathode panel, a light reflected by said reflection layer radiating from said light-output panel toward the outside of said sealed body.

2. A fluorescent lamp according to claim 1, wherein an outer surface of said anode panel is provided with a heat-radiating plate.

3. A fluorescent lamp according to claim 1, wherein said sealed body including said anode panel, said cathode panel and said light-output panel has a contour of a triangular-prism shape.

4. A fluorescent lamp according to claim 1, wherein said sealed body including said anode panel, said cathode panel and said light-output panel has a section of a polygonal shape.

5. A fluorescent lamp according to claim 1, wherein said filament has a line form.

6. A fluorescent lamp according to claim 5, further comprising:

a retainer for supporting said filament, said retainer being non-parallel to said anode panel and being disposed inside said cathode panel.

7. A fluorescent lamp according to claim 6, wherein said retainer is made of a material having conductivity, and an end portion thereof is provided with a lead for applying a voltage to said filament.

8. A fluorescent lamp according to claim 1, wherein said grid electrode has a mesh form.

9. A fluorescent lamp according to claim 8, further comprising:

a retainer for supporting said grid electrode, said retainer being non-parallel to said anode panel and being disposed inside said cathode panel.

10. A fluorescent lamp according to claim 9, wherein said retainer is made of a material having conductivity, and an end portion thereof is provided with a lead used for said grid electrode.

11. A fluorescent lamp according to claim 1, wherein said anode panel and said cathode panel have a coefficient of expansion, which is substantially identical with that of said light-output panel, and are formed by using a material having lower transmittance in comparison with said light-output panel.

12. A fluorescent lamp according to claim 11, wherein said light-output panel is made of a transparent glass plate.

* * * * *